US005151248A

United States Patent [19]

Ebara et al.

[11] Patent Number: 5,151,248

[45] Date of Patent: Sep. 29, 1992

[54] PD-ADDED AUSTENITIC STAINLESS STEEL FOR USE FOR HIGH TEMPERATURE CONCENTRATED SULFURIC ACID

[75] Inventors: Ryuichiro Ebara; Hideo Nakamoto; Naohiko Ukawa; Tamotsu Yamada, all of Hiroshima; Yasuo Nishimura, Tokyo, all of Japan

[73] Assignee: Mitsubishi Jukogyo Kabushiki Kaisha, Tokyo, Japan

[21] Appl. No.: 807,633

[22] Filed: Dec. 13, 1991

Related U.S. Application Data

[63] Continuation of Ser. No. 700,437, May 15, 1991, abandoned.

[30] Foreign Application Priority Data

May 23, 1990 [JP] Japan ..... 2-131258

[51] Int. Cl.[5] ..... C22C 38/40

[52] U.S. Cl. ..... 420/35; 420/50; 420/584.1

[58] Field of Search ..... 420/35, 50, 584

[56] References Cited

U.S. PATENT DOCUMENTS 4,018,569 4/1977 Chang ..... 428/678

4,384,891 5/1983 Barnabé ..... 420/35

4,761,187 8/1988 Paton ..... 420/35

4,933,027 6/1990 Moriya et al. ..... 420/34

FOREIGN PATENT DOCUMENTS 2079787 1/1982 United Kingdom .

OTHER PUBLICATIONS

Davies et al., Application of Saramet in $H_2SO_4$ Plants, British Sulphur's 13th International Conference, Nov. 1988.

*Primary Examiner*—Deborah Yee

*Attorney, Agent, or Firm*—Fleit, Jacobson, Cohn, Price, Holman & Stern

[57] ABSTRACT

An austenitic stainless steel for use for high temperature concentrated sulfuric acid which comprises, on weight basis, 0.04% or less of C, 5-7% of Si, 2% or less of Mn, 15-25% of Cr, 4-24% of Ni, 0.01-1.07% of Pd and the rest consisting of Fe and unavoidable contaminant materials. By the incorporation of small amount of palladium in a basal austenitic stainless steel containing the essential three elements of Cr, Ni and Si, a superior corrosion resistance against highly concentrated high temperature sulfuric acid is attained.

2 Claims, 4 Drawing Sheets

* : IMPOSSIBLE OF ROLLING WORK

PD-ADDED AUSTENITIC STAINLESS STEEL FOR USE FOR HIGH TEMPERATURE CONCENTRATED SULFURIC ACID

This is a continuation of application Ser. No. 07/700,437, filed May 15, 1991, which was abandoned upon the filing hereof.

BACKGROUND OF THE INVENTION

1. Field of the Invention

The present invention relates to an austenitic stainless steel superior not only in the workability but also in the corrosion resistance for use for the material of, such as, absorption towers, cooling towers, pumps, vessels and so on, to be employed in an environment of high temperature concentrated sulfuric acid in sulfuric acid industry, in particular, for dealing with sulfuric acid of a concentration of 90–100% at a temperature of up to 240° C.

2. Description of the Related Art

Sulfuric acid has in general a high corrosive property for metals. Such attack of metals by sulfuric acid is quite considerable especially at medium concentrations of sulfuric acid from about 10 to about 80%. This is attributed mainly to the fact that such medium concentration sulfuric acid is a non-oxidative acid. Existing materials capable of withstanding such sulfuric acid environment are quite limited and may be exemplified, for use at temperatures below 100° C., by lead and some of Ni alloys, such as, Hastelloy B and C276 (trade names).

It is known, on the other hand, that oxidizing conditions take place when sulfuric acid is concentrated up to 90% or higher. For such highly concentrated sulfuric acid, some metals which do not withstand a medium concentration sulfuric acid may become tolerable for use. For example, mild steel has a better corrosion resistance against a highly concentrated sulfuric caid of 98% at lower temperatures, due to formation of an anti-corrosive protective layer of $FeSO_4$ over the entire surface of the steel, so that it finds practical use for such highly concentrated sulfuric acid at room temperature (at around 20° C.).

At higher temperatures up to 240° C. to be encountered in sulfuric acid industry, the attacking action of sulfuric acid becomes violent. At such a high temperature, the protective $FeSO_4$ coating layer of milde steel will tend to dissolve in the highly concentrated sulfuric acid to destroy the anti-corrosive passive layer, resulting in destruction of corrosion resistance of mild steel.

Usual austenitic steels, various ferrite steels and nickel alloys exhibit poor corrosion resistance in such highly concentrated high temperature sulfuric acid and even lead and Ni-alloys, such as Hastelloy B and C-276 (trade names), exihibiting relatively high corrosion resistance in medium concentration sulfuric acid become less resistant at high temperatures to highly concentrated sulfuric acid.

No material has been found up to date, which has sufficient resistance in such environment and which is applicable practically for various installations and instruments in the sulfuric acid industry. However, it has been known, that high Si cast iron (containing more than 14% of Si) exhibits relatively superior corrosion resistance in high concentration sulfuric acid at lower temperatures (below about 120° C.). It has been assumed that Si contributes effectively to the development of anti-corrosive property effectively. It has recently been reported that ferritic stainless steels having high content of Cr exhibit also relatively better corrosion resistance in such an environment. This suggests that Cr may contribute to the development of corrosion resistance effectively and that the content of Ni which is assumed to have a negative effect on the development of anti-corrosive property is low.

However, these steels have poor mechanical workability and, in particular, high Si cast iron is scarcely able to be subject to mechanical working and welding, so that it finds no practical use for large sized installations and instruments. Thus, in the practice, large sized installations to be employed in an environment of highly concentrated sulfuric acid of above 90% at a temperature of up to 120° C., such as, absorption towers and so on, are lined internally with acid-resistant bricks.

Such internal lining suffers from the problems such as follows:

The binder material employed to fill up the interstices between the adjoining acid-resistant bricks will be damaged during the course of long-term operation by the highly concentrated sulfuric acid, which may cause leakage of sulfuric acid, so that it is necessary to incorporate an overhauling of the entire installation at intervals of a few years. Such a damage of the binding material will markedly be accelerated under the conditions with which the present invention deals, namely, sulfuric acid of a concentration of above 90% and a temperature of up to 240° C. and the durability of the brick will also promotively be damaged.

Also, high Cr ferritic stainless steels which have relatively better corrosion resistance as compared with other materials will suffer from corrosion attack under the condition mentioned above and will be subject to a corrosion rate exceeding over the critical allowable value of 0.1 $g/cm^2.hr$ for the practical use. This is because that the content of Cr is not allowed to reach the amount necessary for attaining sufficient corrosion resistance under the condition mentioned above, namely, over 35%, in order to maintain a tolerable workability. When the content of Cr is increased, the resulting high Cr ferritic stainless steel becomes brittle and mechanical working, such as, pressing and rolling, becomes difficult. Upon welding such a high Cr ferritic stainless steel, incorporation of additional technical measures, such as, preheating, after-heating and so on, is necessary for avoiding the hardening of the material around the welded portion, resulting in a considerable increase in the costs for manufacturing and overhauling such installations, as compared with materials of austenitic stainless steels.

As for high Si cast iron, the problem that a mechanical working and welding will scarcely be permitted due to the brittleness of the high Si cast iron is left unsolved.

Under the circumstances of the stand of the technique described above, it is contemplated by the present invention to provide a novel austenitic stainless steel which resolves the disadvantage of poor corrosion resistance associated with the conventional material in the environment of highly concentrated high temperature sulfuric acid and which permits welding and mechanical working without problem.

SUMMARY OF THE INVENTION

Thus, the present invention provides an austenitic stainless steel containing a small amount of palladium and exhibiting a markedly increased corrosion resistance under the environment of highly concentrated high temperature sulfuric acid, which comprises, on weight basis, 0.04% or less of C, 5-7% of Si, 2% or less of Mn, 15-25% of Cr, 4-24% of Ni, 0.01-1.07% of Pd and the rest consisting of Fe and unavoidable contaminant materials.

The essential characteristic feature of the austenitic steel according to the present invention resides in that it comprises three basal elements of Cr, Ni and Si with addition of a small but suitable amount of Pd for attaining a considerably increased corrosion resistance under the environment of highly concentrated high temperature sulfuric acid. In the following, the functions and effects of each component element of the alloy steel according to the present invention will be described with reference to the appended drawings by way of concrete embodiments.

DETAILED DESCRIPTION OF THE PREFERRED EMBODIMENTS

The experimental results and the composition of the steel for each of Examples 1 to 10 and Comparison Examples 11 to 22 are summarized in Table 1.

The each essential component element of the steel according to the present invention has been selected based upon the knowledge and consideration from the experiments as described below:

It has been known that high Si cast iron has a relatively better corrosion resistance to highly concentrated (90-100%) sulfuric acid at higher temperatures (100°-120° C.). This suggests that Si has a certain effect on improving the corrosion resistance of a steel to such sulfuric acid environment. It is also known that increase in the content of Cr in a stainless steel will impart to the steel an improved corrosion resistance to such sulfuric acid environment.

However, it is required in an austenitic stainless steel to increase the Ni content in correspondence to an increase in the total content of the ferrite-forming elements, namely, Cr+Si, in order to maintain the austenite phase which provides a better mechanical workability. It is necessary and preferred to limit the content of Ni in the stainless steel according to the present invention to the minimum amount necessary for maintaining the austenite phase, since it is known that content of Ni has a negative effect on a stainless steel in attaining corrosion resistance to the environment of highly concentrated high temperature sulfuric acid to be dealt with by the present invention.

Figure 1:
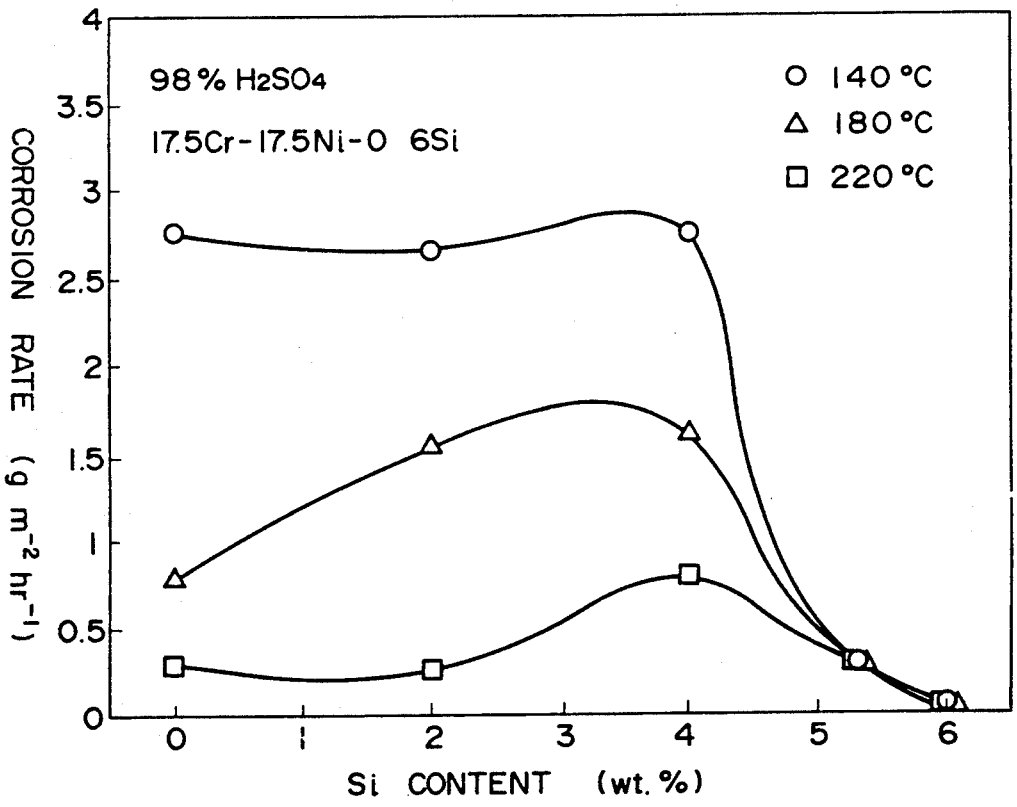
FIG. 1 is a graph showing the relationship between the Si content of steel and the corrosion rate of the steel in highly concentrated high temperature sulfuric acid.

Supported by such knowledge, the inventors made an investigation into a possibility of improving the corrosion resistance of an austenitic stainless steel in such an environment of highly concentrated high temperature sulfuric acid by an increased content of Si in a basal austenitic stainless steel under preservation of the austenite phase attributive to better weldability and higher workability of the steel, in consideration of Schaeffler's phase diagram (a diagram showing the relationship between the metal structure and equivalent proportion of each component alloy element), whereby it was confirmed experimentally that increased contents of Si in the austenitic basal alloy steel will bring about an improvement in the corrosion resistance of the basal austenitic steel against the environment of highly concentrated high temperature sulfuric acid, as shown in FIG. 1.

It is seen in FIG. 1 that the anti-corrosive property of the basal austenitic steel is improved remarkably by the content of Si in an amount over 5%. However, an excessive content of Si in the steel brings about a considerable increase in the hardness of the steel and, when the Si content exceeds about 7%, the increase in the hardness goes beyond the permissible limit for allowing rolling work. Thus, the upper limit of Si content in an austenitic stainless steel for preserving permissible workability may assumably be at about 7%.

Figure 2:
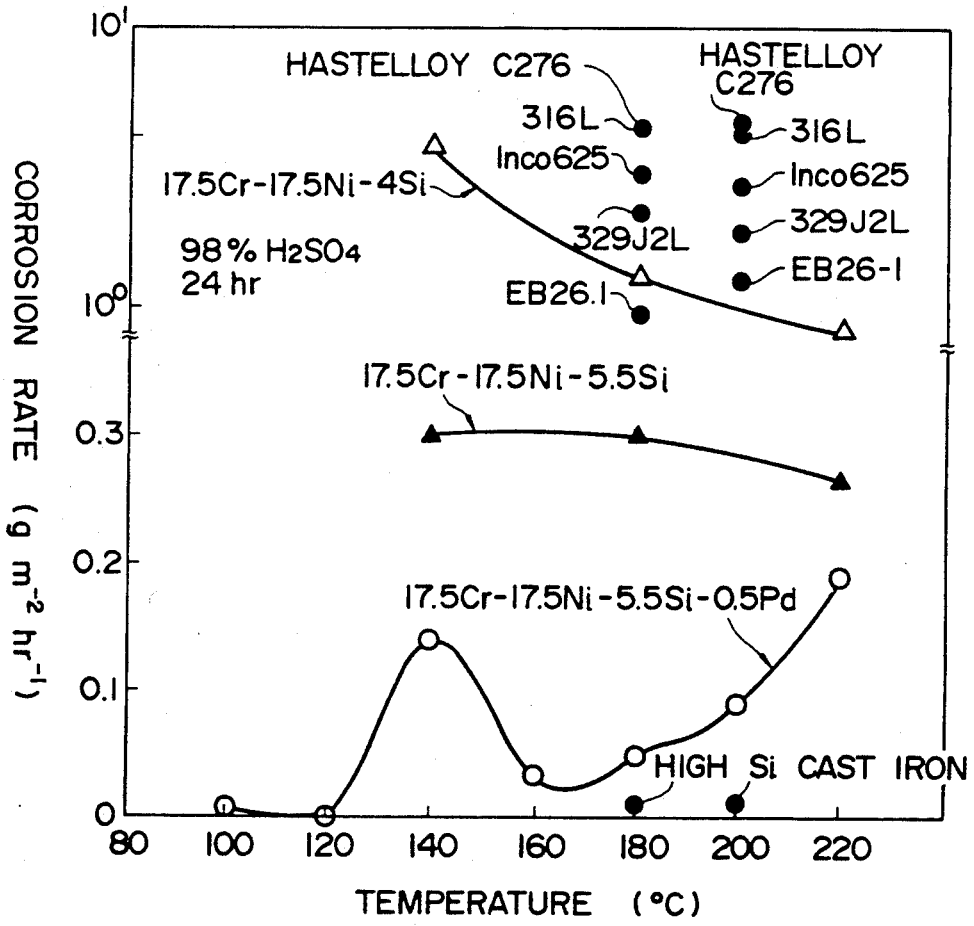
FIG. 2 shows the comparison of temperature dependence of the corrosion rate between the steel according to the present invention and conventional steels.

While, as confirmed experimentally, a better anti-corrosive property is imparted to an austenitic stainless steel by adding Si, the Si content may preferably be lower enough to allow better mechanical working, such as, rolling, pressing and so on. The inventors had therefore looked for a measure for realizing lower possible content of Si in such a basal austenitic stainless steel while maintaining sufficient mechanical workability with enough corrosion resistance against said sulfuric acid environment and have found that addition of small amount of palladium to such basal austenitic stainless steel provides the practical solution therefor. Thus, as shown in FIG. 2, it was discovered that an addition of small amount of Pd to the basal austenitic stainless steel will bring about a remarkable improvement in the anti-corrosive property of the basal austenitic steel under the environment of highly concentrated high temperature sulfuric acid.

Figure 3:
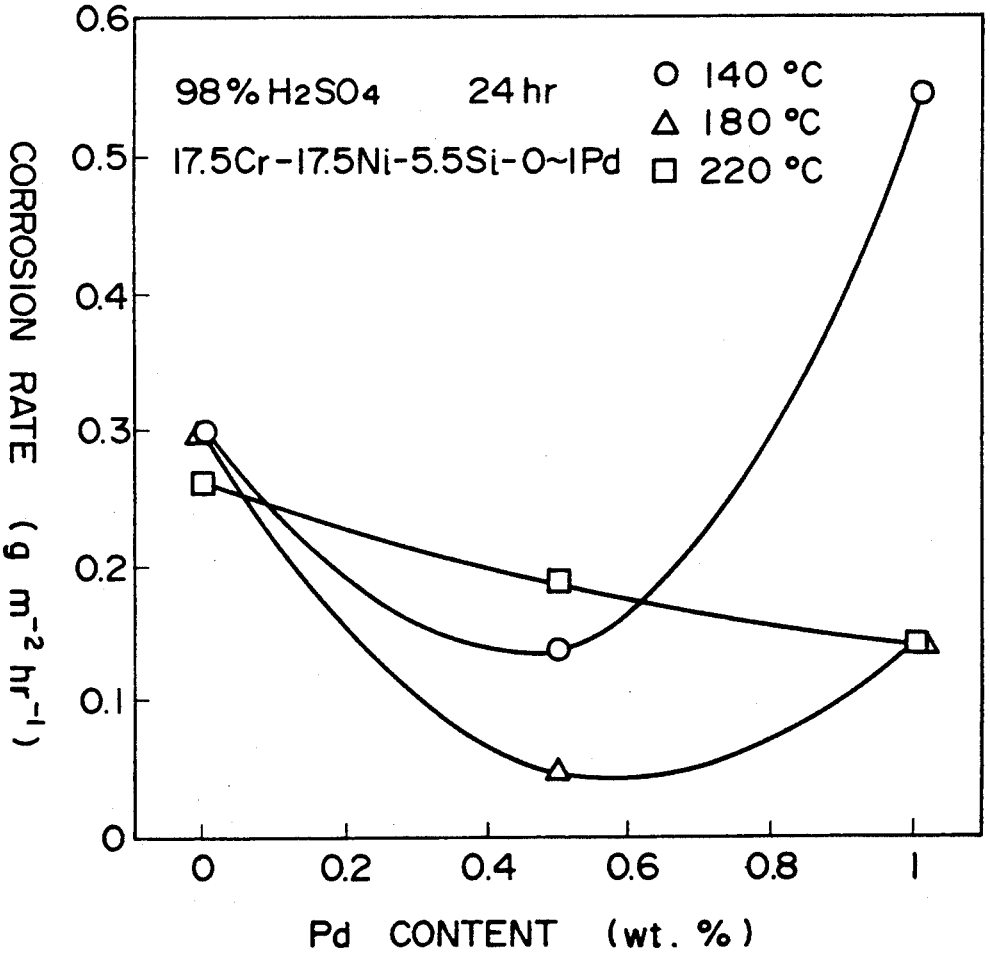
FIG. 3 is a graph showing the relationship between the Pd content and the corrosion rate for the steel according to the present invention.

According to a further study carried out by the inventors, it was confirmed, as shown in FIG. 3, that, with a fixed Si content of 5.5%, the maximum anti-corrosive effect was attained when the Pd content was in the range from 0.2 to 0.6%. Furthermore, it was shown, as seen in Table 1, that a better anti-corrosive property was attained at an Si content of 6.61%, even when the content of Pd amounted to only 0.01%.

While the essential features of the present invention have been given in the paragraph of "Summary of the Invention" and the scope of the present invention is defined in the Patent claims, such a definition of the present invention has been based on the reasons described below.

○ As to the content of carbon (C)

While C has a negative effect on the anti-corrosive property of the basal austenitic steel, it has a positive effect on the development of strength of the steel and some content thereof should be present. Since the anti-corrosive property deteriorates markedly when the carbon content exceeds over 0.04%, the partinent content of C should be in the range from 0.004 to 0.04%.

○ As to the content of silicon (Si)

Si constitutes one of the essential elements of the basal austenitic stainless steel of the present invention and has a fundamental contribution to the development of not only the anti-corrosive property but also the anti-oxidative nature of the steel. The anti-corrosive property of the basal austenitic steel is improved remarkably by an Si content of above 5%. An increase in the Si content also results in an improvement in the anti-corrosive property. However, an Si content over 7% may cause deterioration of mechanical workability. Therefore, the partinent content of Si may be in the range from 5 to 7%.

○ As to the content of manganese (Mn)

Manganese serves as a deoxidizer and is employed in an amount below 2% of the alloy from the point of view of anti-corrosive property of the steel. In the Examples, it was incorporated in the steel in an amount in the range from 0.49 to 0.60%.

○ As to the content of chromium (Cr)

Chromium constitutes one of the essential tertiary elements of the basal austenitic stainless steel according to the present invention. It is necessary, in general, to choose a content of chromium of at least 15%, in order to attain a sufficient anti-corrosive property according to the present invention under the environment of highly concentrated high temperature sulfuric acid. While the anti-corrosive property of the steel improves with increasing the content of chromium, a corresponding increase in the content of Ni becomes necessary for maintaining the austenite phase of the steel and such an increase may counteract to the development of anti-corrosive property due to debasement of the corrosion resistance by higher Ni content. When the content of Cr exceeds 25%, forging becomes difficult. Thus, the pertinent content of Cr should be in the range from 15 to 25%.

○ As to the content of nickel (Ni)

Ni is necessary for maintaining the austenite phase and should be present in an amount in the range from 4 to 24%.

○ As to the content of palladium (Pd)

Palladium constitutes one of the essential elements of the austenitic stainless steel according to the present invention, though it is employed in a small amount. It provides a remarkable improvement of the corrosion resistance against the environment of highly concentrated high temperature sulfuric acid. The effect of improvement of the corrosion resistance is attainable at a Pd content of at least 0.01% and such effect increases as the content of Pd becomes higher. However, a Pd content over 1.07% is meaningless and uneconomical, since the effect of improvement of the corrosion resistance reaches the saturation at this content. Thus, the partinent content of Pd is in the range from 0.01 to 1.07%.

○ As to the unavoidable contaminant materials

They encompass phosphorus (P), sulfur (S), oxygen (0) and so on.

Phosphorus (P) should preferably be contained as little as possible in view of the anti-corrosive property and of hot workability. If it exceeds 0.03%, the hot workability deteriorates.

Sulfur (S) has, like phosphorus, also a large effect on the mechanical workability of the steel and should not be present in an amount higher than 0.014%.

Oxygen should also be kept in the steel as little as possible for the reason similar to that for P and S and the content thereof should preferably be lower than 50 ppm.

It is preferable that the sum of the contents of S and 0 does not exceed 150 ppm.

Examples of the austenitic stainless steel according to the present invention exhibiting a higher anti-corrosive property together with a better mechanical workability comparable to those of conventional anti-corrosive steels are summarized in Table 1 for the alloy composition and the experimental data in comparison with those of conventional steels (Comparison Examples).

Figure 4:
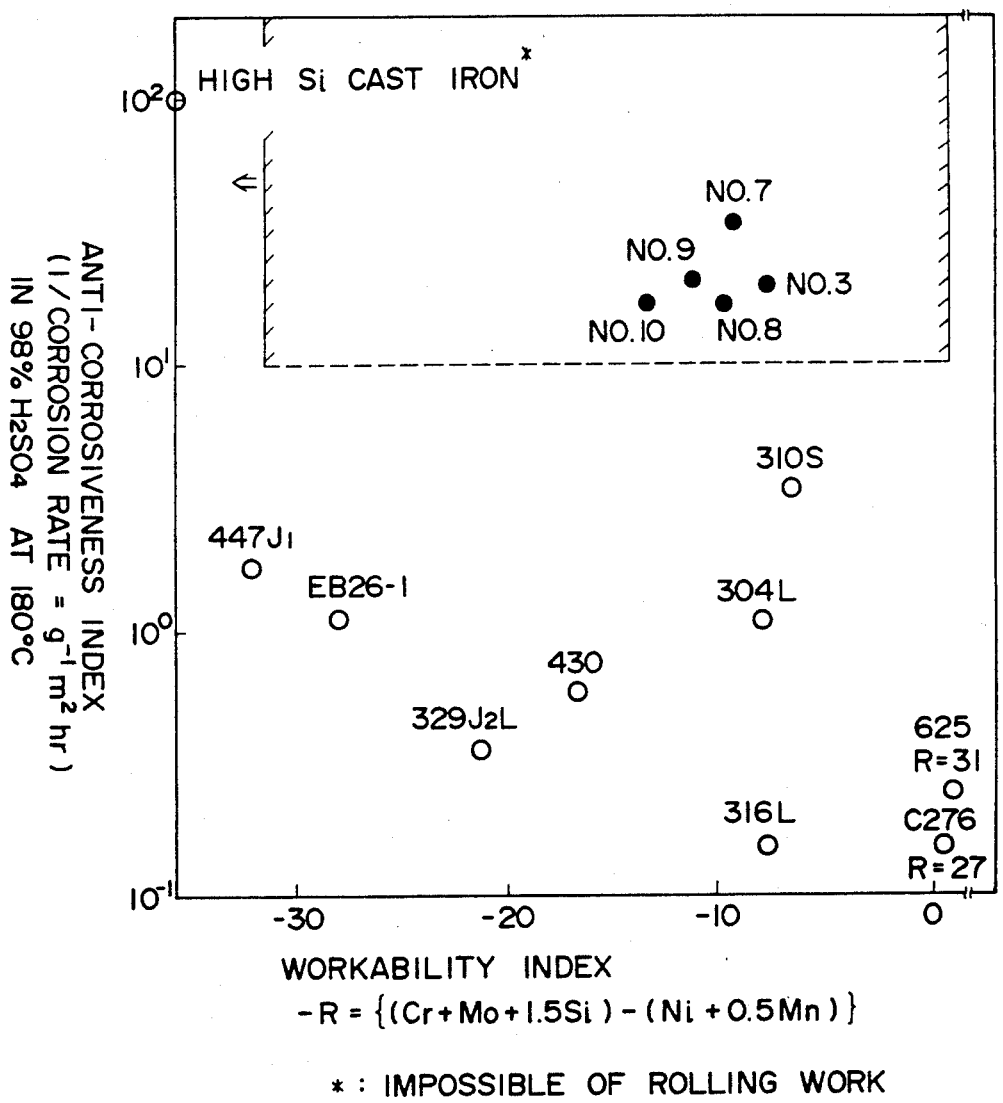
FIG. 4 is a graph showing the comparison of corrosion resistance and mechanical workability between the steel according to the present invention and conventional steels.

The experimental data given in Table 1 are plotted in the graph of FIG. 4 for easy comparison between the steel according to the present invention (indicated by closed circles) and the conventional steel (indicated by open circles).

As a workability index used in FIG. 4, −R is defined as follows:

$$-R = -[(\text{equivalent of Cr}) \text{ minus } (\text{equivalent of Ni})]$$

in which the equivalent of Cr is calculated by $$Cr + Mo + 1.5\ Si$$

and the equivalent of Ni is calculated by $$Ni + 0.5\ Mn$$

The value of R, namely, (eq. of Cr)-(eq. of Ni) is an index for the degree of ease of mechanical working. In general, this value is greater for less workable materials having higher Cr content (for example, the materials SUS 447 J and EB26-1 as given in FIG. 4) and it falls in the range from 7 to 20 for materials exhibiting a relatively better workability and supplied in the market in large amounts (for example, the materials SUS 316L, SUS 304L and so on as given in FIG. 4).

For the Comparison Examples, conventional steels widely produced with solid production records are selected for comparison.

The values of R for Inconel 625 and C 276 are given only by numbers in the graph of FIG. 4, since the values are too large and cannot be plotted on the proper position in the graph.

[Experiments ]

The variation of the hot workability and the anti-corrosive property due to the variation of the alloy composition was investigated for alloy steels according to the present invention (Examples 1 to 10) and for alloy steels of the stand of the technique (Comparison Examples 11 to 22). The alloy steels according to the present invention were prepared in such a manner that the metal components are melted in a vacuum arc smelting furnace and the resulting metal ingot is subjected to a surface treatment before it is hot rolled under a condition normally used for a stainless steel, whereupon the resulting hot rolled strip is subjected to a solid solution treatment. Each specimen of the alloy steels was examined by a corrosion test in which the specimen was immersed in a 98% conc. sulfuric acid at a temperature in the range of, in most cases, 100°-220° C. for 24 hours and the weight loss due to the corrosion was determined by accurately weighing the specimen before and after the immersion.

For the workability of the steels, the values of the workability index explained above were calculated only because such an index is convenient. As explained above, the calculation was based on the equation:

$$-R = -[(\text{equivalent of Cr}) \text{ minus } (\text{equivalent of Ni})]$$

in which the equivalent of Cr is calculated by

Cr+Mo+1.5 Si and the equivalent of Ni is calculated by

Ni+0.5 Mn

From the data given in Table 1, it is clear that the austenitic stainless steels according to the present invention having a Pd content of 0.5% (Examples 2, 3 and 4) are superior in the corrosion resistance against the highly concentrated sulfuric acid as compared with the prior art steel having a similar composition without Pd content (Comparison Example 17). It is seen further that the corrosion resistance of the steels according to the present invention having a Pd content of 0.5% (Examples 2, 3 and 4) is superior than that of the steels according to the present invention having a Pd content of 1.07% (Examples 5 and 6).

It is seen moreover, that the workability of the steels according to the present invention may be comparable to that of the convectional steel for use in the environment of sulfuric acid employed practically and most frequently (Comparison Example 11).

As described in detail above, an austenitic stainless steel for use in an environment of highly concentrated high temperature sulfuric acid which exhibits superior anti-corrosive property together with better workability and which is based upon a basal alloy steel containing the three elements of chromium, nickel and silicon with addition of a small amount of palladium can be provided by the present invention. The austenitic stainless steel according to the present invention offers a wider applicability in the sulfuric acid industry due to its superior corrosion resistance even at higher temperatures together with its better workability.

TABLE 1

| | Examples No. | | | | |
|---|---|---|---|---|---|
| | 1 | 2 | 3 | 4 | 5 |
| Composition (%) | | | | | |
| C | 0.013 | 0.011 | 0.011 | 0.011 | 0.014 |
| Si | 5.21 | 5.63 | 5.63 | 5.63 | 5.41 |
| Mn | 0.60 | 0.52 | 0.52 | 0.52 | 0.55 |
| P | 0.012 | 0.013 | 0.013 | 0.013 | 0.013 |
| S | 0.011 | 0.011 | 0.011 | 0.011 | 0.010 |
| Ni | 4.02 | 17.72 | 17.72 | 17.72 | 17.49 |
| Cr | 17.62 | 17.65 | 17.65 | 17.65 | 17.58 |
| Mo | — | — | — | — | — |
| Cu | — | — | — | — | — |
| Pd | 0.10 | 0.51 | 0.51 | 0.51 | 1.07 |
| N | — | — | — | — | — |
| Others | — | — | — | — | — |
| Denotation | — | — | — | — | — |
| Workability Index R[1)] | 21.18 | 8.20 | 8.00 | 8.10 | 8.05 |
| Corrosion test | | | | | |
| Temp. (°C.) | 220 | 160 | 180 | 220 | 180 |
| Corrosion Rate[2)] | 0.17 | 0.03 | 0.05 | 0.18 | 0.13 |

| | Example No. | | | | |
|---|---|---|---|---|---|
| | 6 | 7 | 8 | 9 | 10 |
| Composition (%) | | | | | |
| C | 0.014 | 0.011 | 0.013 | 0.016 | 0.015 |
| Si | 5.41 | 6.61 | 5.23 | 5.30 | 5.32 |
| Mn | 0.55 | 0.51 | 0.55 | 0.49 | 0.60 |
| P | 0.013 | 0.012 | 0.014 | 0.013 | 0.012 |
| S | 0.010 | 0.011 | 0.010 | 0.010 | 0.010 |
| Ni | 17.49 | 17.64 | 18.24 | 18.61 | 18.74 |
| Cr | 17.58 | 17.65 | 20.62 | 22.31 | 24.65 |
| Mo | — | — | — | — | — |
| Cu | — | — | — | — | — |
| Pd | 1.07 | 0.01 | 0.52 | 0.51 | 0.49 |
| N | — | — | — | — | — |
| Others | — | — | — | — | — |
| Denotation | — | — | — | — | — |
| Workability Index R[1)] | 8.07 | 9.72 | 9.99 | 11.46 | 13.68 |
| Corrosion test | | | | | |
| Temp. (°C.) | 220 | 180 | 180 | 180 | 180 |
| Corrosion Rate[2)] | 0.14 | 0.03 | 0.06 | 0.05 | 0.06 |

| | Comparison Example No. | | | | |
|---|---|---|---|---|---|
| | 11 | 12 | 13 | 14 | 15 |
| Composition (%) | | | | | |
| C | 0.016 | 0.003 | 0.04 | 0.14 | 0.005 |
| Si | 0.67 | 0.03 | 0.16 | 0.014 | 0.09 |
| Mn | 1.27 | 0.50 | 0.27 | 0.88 | 0.11 |
| P | 0.031 | 0.010 | 0.004 | 0.028 | 0.013 |
| S | 0.003 | 0.005 | 0.001 | 0.001 | 0.003 |
| Ni | 12.07 | Bal. | 60.9 | 7.21 | — |
| Cr | 17.30 | 15.40 | 20.90 | 25.15 | 26.79 |
| Mo | 2.05 | 15.6 | 8.8 | 3.20 | 1.30 |
| Cu | — | — | — | 0.47 | — |
| Pd | — | — | — | — | — |
| N | — | — | — | 0.14 | 0.08 |
| Others | — | 3) | 4) | | |
| Denotation | 316L | C276 | Inconel625 | $329J_2L$ | EB26-1 |
| Workability Index R[1)] | 7.65 | −27.05 | −31.1 | 21.32 | 28.18 |
| Corrosion test | | | | | |
| Temp. (°C.) | 180 | 180 | 180 | 180 | 180 |
| Corrosion Rate[2)] | 6.61 | 6.60 | 4.17 | 2.78 | 0.90 |

| | Comparison Example No. | | | | |
|---|---|---|---|---|---|
| | 16 | 17 | 18 | 19 | 20 |
| Composition (%) | | | | | |
| C | 0.012 | 0.015 | 0.74 | 0.010 | 0.07 |
| Si | 4.03 | 5.52 | 14.85 | 0.60 | 0.75 |
| Mn | 0.55 | 0.50 | 0.38 | 1.22 | 0.79 |
| P | 0.015 | 0.019 | 0.05 | 0.033 | 0.014 |
| S | 0.010 | 0.010 | 0.01 | 0.005 | 0.001 |
| Ni | 17.55 | 17.62 | — | 10.42 | 19.12 |
| Cr | 17.50 | 17.53 | — | 18.24 | 25.06 |
| Mo | 0.031 | 0.054 | — | — | — |
| Cu | 0.020 | 0.029 | 0.43 | — | — |
| Pd | — | — | — | — | — |
| N | 0.031 | 0.040 | — | — | — |
| Others | — | — | — | — | — |
| Denotation | 6) | 7) | 8) | SUS 394L | SUS 310S |
| Workability Index R[1)] | 5.75 | 7.99 | 9) | 8.11 | 6.67 |
| Corrosion test | | | | | |
| Temp. (°C.) | 180 | 180 | 180 | — | — |
| Corrosion Rate[2)] | 1.61 | 0.30 | 0.01 | 0.927 | 0.297 |

| | Comp. Example No. | |
|---|---|---|
| | 21 | 22 |
| Composition (%) | | |
| C | 0.004 | 0.06 |
| Si | 0.11 | 0.25 |
| Mn | 0.11 | 0.50 |
| P | 0.020 | 0.032 |
| S | 0.005 | 0.005 |
| Ni | — | — |
| Cr | 30.38 | 16.62 |
| Mo | — | — |
| Cu | — | — |
| Pd | — | — |
| N | — | — |
| Others | — | — |
| Denotation | SUS $447J_1$ | SUS 430 |
| Workability Index R[1)] | 30.49 | 16.75 |
| Corrosion test | | |
| Temp. (°C.) | — | — |

TABLE 1-continued

| | | |
|---|---|---|
| Corrosion Rate[2)] | 0.581 | 1.700 |

[1)]R = (Cr + Mo + 1.5 Si) − (Ni + 0.5 Mn)
[2)]Of units in $g/cm^2/hr$
[3)]Co 0.80, W 3.70 and Fe 6.1
[4)]Ti 0.24, Al 0.29, Cd + Ta 3.51 and Fe 4.0
[5)]W 0.34
[6)]17.5Cr—17.5Ni—4Si
[7)]17.5Cr—17.5Ni—5.5Si
[8)]High Si cast iron
[9)]Impossible of rolling work

We claim:

1. An austenitic stainless steel for use for high temperature concentrated sulfuric acid, comprising, on weight basis, 0.04% or less of C, 5-7% of Si, 2% or less of Mn, 15-25% of Cr, 4-24% of Ni, 0.01-1.07% of Pd and the rest consisting of Fe and unavoidable contaminant materials.

2. An austenitic stainless steel as claimed in claim 1, wherein the unavoidable contaminant materials contain P and S each in a minute amount.

* * * * *